US005655280A

United States Patent [19]

McCommon

[11] Patent Number: 5,655,280

[45] Date of Patent: Aug. 12, 1997

[54] OIL PLUG SEAT

[76] Inventor: Robert McCommon, 604 Lupine Cir., Vacaville, Calif. 95687

[21] Appl. No.: 404,092

[22] Filed: Mar. 14, 1995

Related U.S. Application Data

[63] Continuation-in-part of Ser. No. 59,568, Jun. 28, 1995, abandoned.

[51] Int. Cl.[6] ..... B23P 19/04

[52] U.S. Cl. ..... 29/243.518; 29/282; 29/402.09; 411/34

[58] Field of Search ..... 29/243.577, 402.09, 29/402.14, 402.15, 402.02, 402.19, 282; 411/34, 38, 55, 183; 184/1.5; 123/196 R

[56] References Cited

U.S. PATENT DOCUMENTS

| | | | |
|---|---|---|---|
| 1,509,327 | 9/1924 | Winchester | 184/1.5 X |
| 1,816,004 | 7/1931 | Collier | 184/1.5 |
| 2,562,336 | 7/1951 | Seiden | 411/34 X |
| 3,119,177 | 1/1964 | Knecht | 29/402.09 X |
| 5,107,808 | 4/1992 | Mahn et al. | 184/1.5 X |

FOREIGN PATENT DOCUMENTS

| | | | |
|---|---|---|---|
| 3009079 | 9/1980 | Germany | 29/402.09 |

OTHER PUBLICATIONS

Two Sheets of drawings from French Patent 590054.

*Primary Examiner*—Peter Vo
*Assistant Examiner*—Khan V. Nguyen
*Attorney, Agent, or Firm*—William S. Bernheim

[57] ABSTRACT

The invention is a device for replacing the seat for an oil plug frequently found as part of an oil pan of an internal combustion engine to allow draining and includes a hollow cylinder having a shoulder for insertion through the existing seat to extent into the oil pan, an installation bolt is employed for compressing and expending the hollow cylinder outward to fixedly secure the hollow cylinder to the existing seat between the shoulder and expended cylinder and the cylinder being internally threaded adjacent the shoulder to accept a plug.

1 Claim, 2 Drawing Sheets

OIL PLUG SEAT

RELATED U.S. APPLICATION

Continuation-in-part of Ser. No. 08/059,568 filed Jun. 28, 1993 abandoned.

BACKGROUND OF THE INVENTION

1. Field of the Invention

The present invention relates to a device for replacing the seat for an oil plug in the oil pan of an internal combustion engine.

2. Description of the Prior Art

Internal combustion engines require lubrication to continue operation. Typically, lubrication is provided by circulating oil through the engine, the oil being pumped from a reservoir where it collects below the engine. This oil, although filtered, becomes dirty and requires periodic replacement. Replacement is accomplished by draining the reservoir, frequently referred to as an oil pan, of the used oil and then adding new oil. For draining purposes, the pan is fabricated with a removal plug.

The plug accompanied by a washer to prevent leakage, is normally screwed into a threaded seat formed in the wall of the pan. Unfortunately, the seat frequently fails due to the thinness of the pan material and either cross threading of the seat with the plug or the use of excessive force when screwing in the plug. Once the seat has failed, the engine owner is in for a considerable expense in terms of welding in a new seat or replacement of the pan. Replacement of the pan is also environmentally undesirable as it requires disposal of additional contaminated materials.

Although simple rubber type stoppers have been tried, the temperature variations of the fluid in the pan cause the stopper materials to lose elasticity and leak.

Statement of the Objects

Accordingly, it is an objective of the present invention to provide a replacement seat without need to remove the pan. It is a further object that the seat not require welding. Yet another object is to avoid plug failure due to temperature variation.

Other objectives, advantages and novel features of the invention will become apparent to those skilled in the art upon examination of the invention and the accompanying drawings.

SUMMARY OF THE INVENTION

The foregoing objects are achieved with a device containing a member which is first inserted into a damaged seat of an oil pan then caused to grip the pan and seat. The member is composed of an elongated hollow cylinder that is internally threaded on an end that is inserted through the seat and into the oil pan and a shoulder on an opposite end which is too large to pass through the damaged seat. The member is biased to splay outward when a shaft that is threaded into the internal threads of the end of the member to pull on the member to cause the member to collapse in length causing the member to grip the pan and seat.

The device contains a replacement seat which is attached to the shoulder of the member, the replacement seat being of a standard size and threaded internally to fit common oil plugs. An oil plug can be threaded tightly into the replacement seat, the device and the plug forming a seal that prevents oil from escaping the oil pan. The plug is removable from the device, allowing the oil to be replaced.

BRIEF DESCRIPTION OF THE DRAWINGS

The following detailed description taken in conjunction with the accompanying drawings illustrate a preferred embodiment of the invention. The drawings are:

FIG. 4 shows a subsequent step to. FIG. 3 in the installation of the inventive device.

DETAILED DESCRIPTION OF A PREFERRED EMBODIMENT

Figure 1:
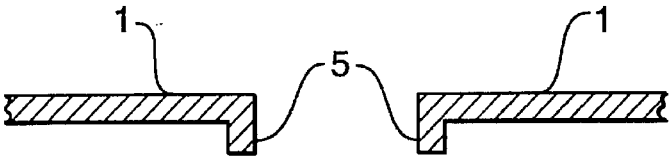
FIG. 1 is a partial side view of an oil pan

FIG. 1 schematically shows the drain plug area of an oil pan 1 containing a seat 5 which is to be replaced. Referring now to FIG. 1 the oil pan 1 and seat 5 are drawn vertically inverted from their normal positions as an aid to illustration.

Figure 2:
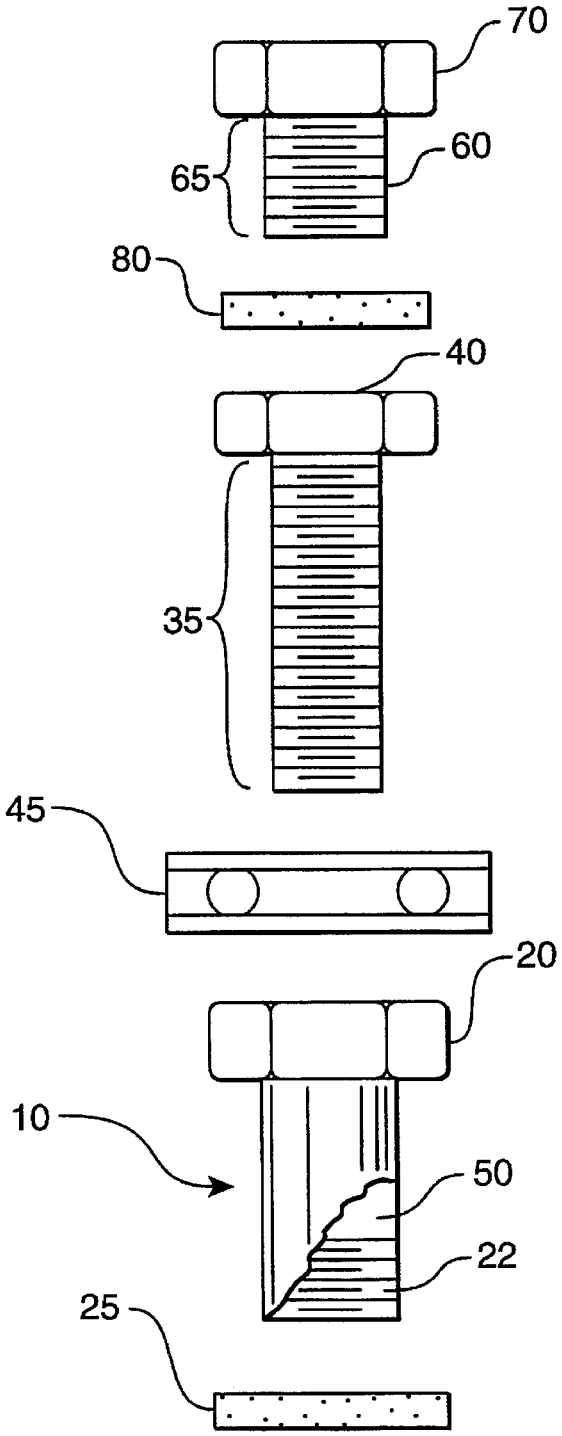
FIG. 2 is an exploded side view of the elements of a device in accordance with the invention.

FIG. 2 is an exploded side view of elements of the invention. The elements include an elongated hollow cylindrical member 10 made from metal to form a crush seat. The member 10 has an enlarged hexagonal head 20 at one end having a cylindrical passageway therethrough and an internally threaded portion 22 on the interior surface on the end distal to the enlarged hexagonal head 20. The passageway through head 20 is also internally threaded but with a larger diameter than that of threaded portion 22. The two threaded portions of member 10 should be coaxial. The metal of member 10 between the hexagonal head 20 and threaded portion 22 is weakened by being formed with thinner walls or by cutting slits or diamonds, so upon applying pressure to draw the head 20 and threaded portion 22 together the wall will collapse in the same manner as a molly fastener. A ring shaped gasket 25 is slipped over the threaded portion 22 of the member 10 to seat against the shoulder formed by the enlarged hexagonal head 20.

An installation bolt is needed and has an elongated cylindrical threaded shaft 35 and an enlarged hexagonal head 40. The exterior threads of bolt fit the internal threads of the threaded portion 22. For ease of installation an annular installation bolt bearing 45 is slipped over the shaft 35 to seat against the shoulder formed by the enlarged hexagonal head 40. Two wrenches not shown are used, one on hexagonal head 20 and the other on hexagonal head 40. Last is a drain plug 60 having a threaded shaft 65 and an enlarged head 70. A ring shaped gasket 80 is slipped over the threaded portion 35 of the plug 60 to seat against the shoulder formed by the enlarged head 70. The exterior threads of plug 60 fit the internal threads of the enlarged head 20.

Figure 3:
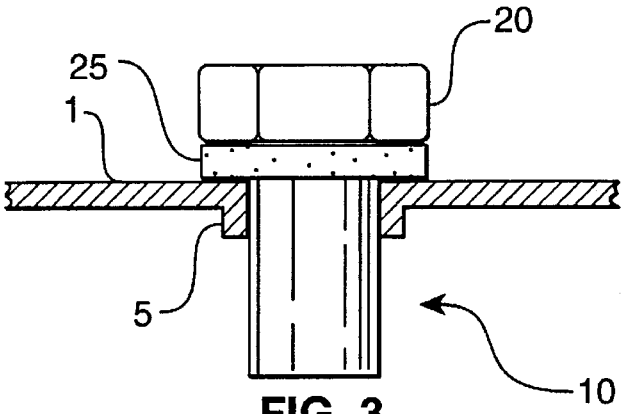
FIG. 3 shows a step in the installation of the inventive device.

To form and install the replaced oil plug seat, as shown in FIG. 3, the threaded portion 22 of the member 10 is inserted first through the gasket 25 and then through the seat 5 from the outside of the oil pan 1.

Figure 4:
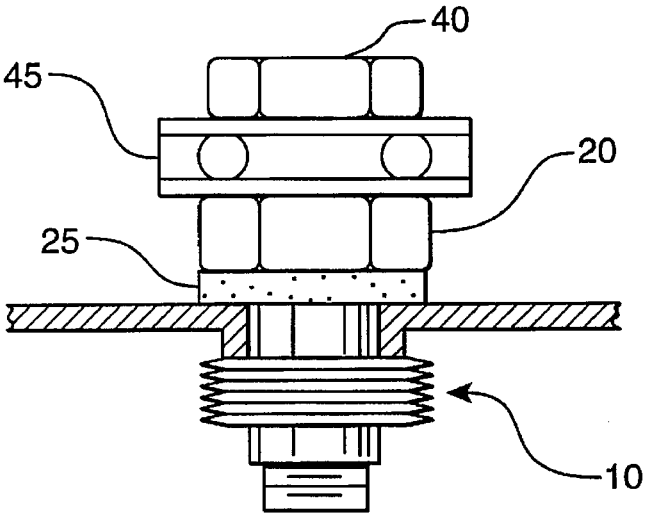
Figure 5:
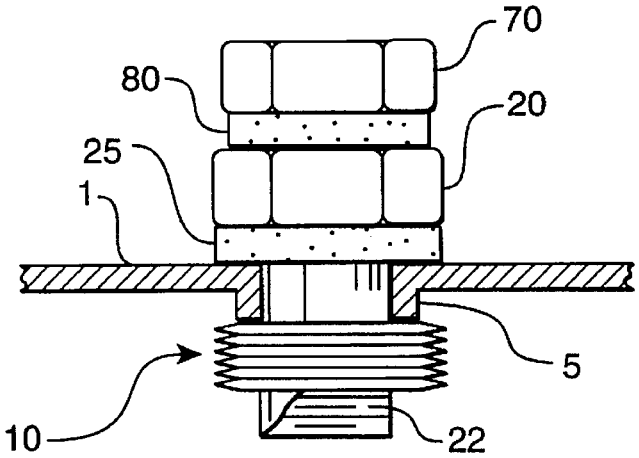
FIG. 5 shows an oil plug seat with seal in place in accordance with the invention.

As shown in FIG. 4, the installation bolt is then inserted first through the bearing 45 and then through the hollow cylindrical member 10. The shaft 35 is then threaded into the threaded portion 22 of the member 10. A wrench is attached to the hexagonal head 20 of member 10 to hold the head 20 stationary relative to the oil pan 1. A second wrench is attached to the hexagonal head 40 of the bolt. The second wrench is rotated so that the bolt 30 draws the threaded portion 22 toward the hexagonal head 20 by compressing and collapsing the member 10 between the hexagonal head 20 and threaded portion 22 by having that portion of member 10 splay outward. The bolt is rotated until splay of member 10 is sufficient to firmly clamp the seat 5 between the enlarged head 20 and the splayed portion of the member 10 and the gasket 25 is forming a tight seal. The bolt is then unscrewed and removed using the wrenches to leave the member 10 firmly in place.

The drain plug 60 is inserted through the gasket 70 and then threaded into the internally threaded passageway through the enlarged head 20 of member 10 so that gasket 70 is forming a tight seal. The oil pan can now be refilled with oil. For the next oil change it is only necessary to remove drain plug 60. Preferably, during both the tightening and loosening of the drain plug 65, a wrench is attached to the crush plug head 20 to prevent the crush plug from moving relative to the oil pan 1.

Due to this difference in diameters of the threaded portions of member 10, the threaded shaft 65 of the drain plug 60 threads into the threading within the enlarged head 20 of the crush plug and not into the threading 20 distal to the enlarged head 20. This difference in diameters conversely causes the installation bolt shaft 35 to thread into the threading 22 distal to the enlarged head 20 and not into the threading within the enlarged head 20 of the crush plug. The shaft 60 of the drain plug is short so that does not come in contact with the threaded portion 20 of the member.

The foregoing description and drawings were given for illustrative purposes only, it being understood that the invention is not limited to the embodiments disclosed, but is intended to embrace any and all alternatives, equivalents, modifications and rearrangements of elements of the invention as defined by the following claims.

What is claimed is:

1. A device for replacement of a seat for a plug in a wall of an oil pan comprising:

(a) a means which includes a member which is insertable through an existing seat and compressible to allow the member to be clampable to the interior and exterior surfaces of the wall of the oil pan;

(b) a means for sealing the replacement seat;

(c) wherein the member is comprised of an elongated hollow cylinder having an inside and an outside, and a front end and a back end, the back end ringed by a shoulder with a diameter too large to fit through the seat being replaced, the front end having a means for pressing on the interior surface of the wall after being inserted through the seat being replaced;

(d) wherein the means for pressing on the interior surface of the wall includes threading on the inside of the front end of the member and the wall of the member is compressible to splay outward between the threads and the shoulder of the member;

(e) wherein the front end is comprised of material that tends to retain its shape after compression, thereby continuing to clamp the interior and exterior surfaces of the wall;

(f) wherein the interior of the member adjacent the shoulder is threaded to accept a plug and the cross section of a threaded length is larger than and coaxial to the cross section of a threaded length portion of the member adjacent the front end; and (g) wherein the means for sealing the replacement seat comprises:

i. a drain plug that can be detachably inserted into the larger threaded cylindrical aperture;

ii. an annular gasket that can be compressed between the replacement seat and a shoulder of the drain plug;

iii. another annular gasket that is compressed between the exterior surface of the wall and the shoulder of the member; and iv. an outside surface of the front end of the member which surface is clamped to the interior surface of the wall.

* * * * *